US010679455B2

(12) United States Patent
Yoshida

(10) Patent No.: US 10,679,455 B2
(45) Date of Patent: Jun. 9, 2020

(54) ITEM DISPENSING DEVICE

(71) Applicant: Masuki co., ltd, Saitama (JP)

(72) Inventor: Takashi Yoshida, Saitama (JP)

(73) Assignee: Masuki co., ltd, Saitama (JP)

( * ) Notice: Subject to any disclaimer, the term of this patent is extended or adjusted under 35 U.S.C. 154(b) by 0 days.

(21) Appl. No.: 16/218,295

(22) Filed: Dec. 12, 2018

(65) Prior Publication Data

US 2019/0114866 A1 Apr. 18, 2019

Related U.S. Application Data

(63) Continuation of application No. PCT/JP2017/046097, filed on Dec. 22, 2017.

(30) Foreign Application Priority Data

Jan. 17, 2017 (JP) ..... 2017-005548

(51) Int. Cl.
*G07F 11/54* (2006.01)
*G07F 11/44* (2006.01)
(Continued)

(52) U.S. Cl.
CPC ..... *G07F 11/54* (2013.01); *G07F 11/20* (2013.01); *G07F 11/24* (2013.01); *G07F 11/44* (2013.01)

(58) Field of Classification Search
CPC ..... B65G 64/48; G07F 11/16; G07F 11/44; G07F 11/22; G07F 11/24; G07F 11/54; G07F 11/20
(Continued)

(56) References Cited

U.S. PATENT DOCUMENTS 3,998,356 A * 12/1976 Christensen ..... A61J 7/0481 221/2
4,109,825 A * 8/1978 Weitzman ..... G07F 11/54 221/122
(Continued)

FOREIGN PATENT DOCUMENTS

JP S61-084979 U 6/1986
JP H07-168972 A 7/1995
(Continued)

OTHER PUBLICATIONS

International Search Report issued in PCT/JP2017/046097 dated Jan. 23, 2018 with English Translation (4 pages).
(Continued)

*Primary Examiner* — Rakesh Kumar
(74) *Attorney, Agent, or Firm* — Nakanishi IP Associates, LLC

(57) ABSTRACT

An item dispensing device includes a plurality of stacked item ejection units, a cylindrical shared delivery pipe penetrating throughout the item ejection units, and an item dispensing unit connected to a lower end of the shared delivery pipe and provided with an item dispensing slot. A plurality of item ejection ports are opened in side wall portions of the shared delivery pipe. The item ejection unit includes a circular rotor and an energizing mechanism. In the rotor, item holders opened radially inward are disposed intermittently along the circumferential direction. The energizing mechanism energizes the item held in any one of the plurality of item holders radially inward and pushes out the item through an opening of the item holder substantially horizontally to the item ejection port when the opening is aligned with the item ejection port with rotation of the rotor.

3 Claims, 21 Drawing Sheets

(51) Int. Cl.
*G07F 11/24* (2006.01)
*G07F 11/20* (2006.01)

(58) Field of Classification Search
USPC ..... 221/265, 124
See application file for complete search history.

(56) References Cited

U.S. PATENT DOCUMENTS

| | | | | | |
|---|---|---|---|---|---|
| 4,809,877 | A * | 3/1989 | Albright | A61J 7/0481 | 221/121 |
| 4,911,327 | A * | 3/1990 | Shepherd | A61J 7/0481 | 221/15 |
| 5,152,422 | A * | 10/1992 | Springer | A61J 7/0084 | 221/113 |
| 5,522,525 | A * | 6/1996 | McLaughlin | G16H 20/13 | 221/4 |
| 6,299,019 | B1 * | 10/2001 | Leight | A61F 15/001 | 221/186 |
| 7,051,900 | B2 * | 5/2006 | Reeves | F41B 11/55 | 124/44.7 |
| 7,673,559 | B2 * | 3/2010 | Zurcher | A47J 31/4492 | 99/295 |
| 9,218,458 | B2 * | 12/2015 | Baarman | G06Q 10/087 | |
| 10,217,310 | B2 * | 2/2019 | Ma | G07F 11/24 | |
| 2007/0145066 | A1 * | 6/2007 | Knoth | G07F 17/0092 | 221/265 |

FOREIGN PATENT DOCUMENTS

| | | | | |
|---|---|---|---|---|
| JP | H08-115467 | A | 5/1996 | |
| JP | H08-129676 | A | 5/1996 | |
| JP | H10-083477 | A | 3/1998 | |
| JP | 2006-095243 | A | 4/2006 | |
| JP | 2007-034603 | A | 2/2007 | |
| JP | 2013-149229 | A | 8/2013 | |
| WO | WO-2018135236 | A1 * | 7/2018 | G07F 11/44 |

OTHER PUBLICATIONS

Office Action issued in Japanese Patent Application No. 2017-083350 dated Jan. 28, 2020, with English Translation (10 pages).

* cited by examiner

ITEM DISPENSING DEVICE

CROSS-REFERENCE TO RELATED APPLICATIONS

This application is a continuation application of International Patent Application No. PCT/JP2017/046097 filed on Dec. 22, 2017, which is based upon and claims the benefit of priority from the prior Japanese Patent Application No. 2017-005548, filed Jan. 17, 2017, the entire contents of which are incorporated herein by reference.

TECHNICAL FIELD

The present invention relates to an item dispensing device for dispensing one item at a time, such as a capsule stored in a stocker case, and more particularly, to an item dispensing device that can reduce the height of the device.

BACKGROUND ART

Capsule vending machines (item dispensing devices), such as shown in FIG. 21, for vending items such as capsule toys are known. In a capsule vending machine 300, a disc-shaped rotor 330 is placed in a lower part of a stocker case 310, which stores a large number of capsules (items) C. A plurality of, e.g., four, circular holes (item holders) are arranged in the rotor 330 along its circumferential direction. One capsule C is held in each of the holes. One circular item ejection hole 311 is opened in the bottom of the stocker case 310. For example, when a customer turns a lever manually, thereby rotating a rotor 330, and any of the four item holders of the rotor 330 is aligned with the item ejection hole 311 in the bottom of the stocker case 310, a capsule C falls through the item ejection hole 311 to an item dispensing portion 320. The customer can take out the capsule C from the item dispensing portion 320. This structure similarly applies to Patent Literature 1.

CITATION LIST

Patent Literature

Patent Literature 1: Japanese Patent Laid-Open No. 2013-149229

SUMMARY OF INVENTION

Technical Problem

Item dispensing devices such as the capsule vending machine 300 described above have the following problem: the device needs to be formed higher than the height of the stocker case 310 by a dimension T necessary for the capsule C to fall in order to allow the capsule C to fall through the item ejection hole 311 opened in the bottom of the stocker case 310. The same height as that of the capsule C is required for the dimension T at the minimum. On the other hand, considering height of the target customer, the total height needs to be reduced to some extent (about 150 cm).

Thus, when a plurality of capsule vending machines 300 are used in a stacked manner, the same height as those of the stocker case 310 plus the dimension T is required for each machine 300, so it is necessary to reduce the number of stored capsules C to reduce the height of the stocker case 310 or reduce the number of stocker cases 310 while the height of the case is unchanged. There is a risk that it could be inconvenient for customers to experience that the capsules C easily became out of stock due to the reduced number of stored capsules C or that the item types were reduced due to the reduced number of the cases.

Thus, an object of the present invention is to provide an item dispensing device that can reduce the height thereof.

Solution to Problem

An item dispensing device according to the present invention includes: a plurality of stacked item ejection units; a cylindrical shared delivery pipe penetrating throughout the plurality of stacked item ejection units, wherein a plurality of side-wall portions corresponding to the plurality of item ejection units are opened as a plurality of item ejection ports; and an item ejection unit connected to a lower end of the shared delivery pipe and having an item dispensing slot, wherein the item ejection unit includes: a cylinder for storing a plurality of items; a circular rotor rotatably provided in a lower part of, and coaxially with the cylinder, wherein the rotor has an opening in which a plurality of substantially half-oval item holders for holding one item in each holder with an opening formed radially inward are disposed intermittently along the circumferential direction; and an energizing mechanism for energizing an item held in one of the plurality of item holders radially inward and pushing out the item through an opening of the item holder substantially horizontally to the item ejection port when the opening is aligned with the item ejection port with rotation of the rotor.

Advantageous Effects of Invention

According to the present invention, the height of the item dispensing device can be reduced.

DESCRIPTION OF EMBODIMENTS

The first and second embodiments of the present invention will be described below with reference to the accompanying drawings. Item dispensing devices with item ejection units stacked according to the first and second embodiments are characterized in that a shared item delivery passage from each of the plurality of stacked item ejection units to an item ejection unit is used, and further, the shared delivery passage is provided inside the device. This makes it possible not only to reduce the height and width of a single item ejection unit and of the entire item dispensing device with the item ejection units stacked, but also to improve the aesthetic appearance of the device because the delivery passage is not exposed outside the device.

Note that although a stocker case and a shared delivery pipe which constitute an item ejection unit are described as being of circular cylindrical bodies in the following embodiments, the shapes of the cylindrical bodies are not limited thereto. These may be any polygonal cylindrical body such as a square cylindrical body, a hexagonal cylindrical body or the like.

Example 1

Figure 1:
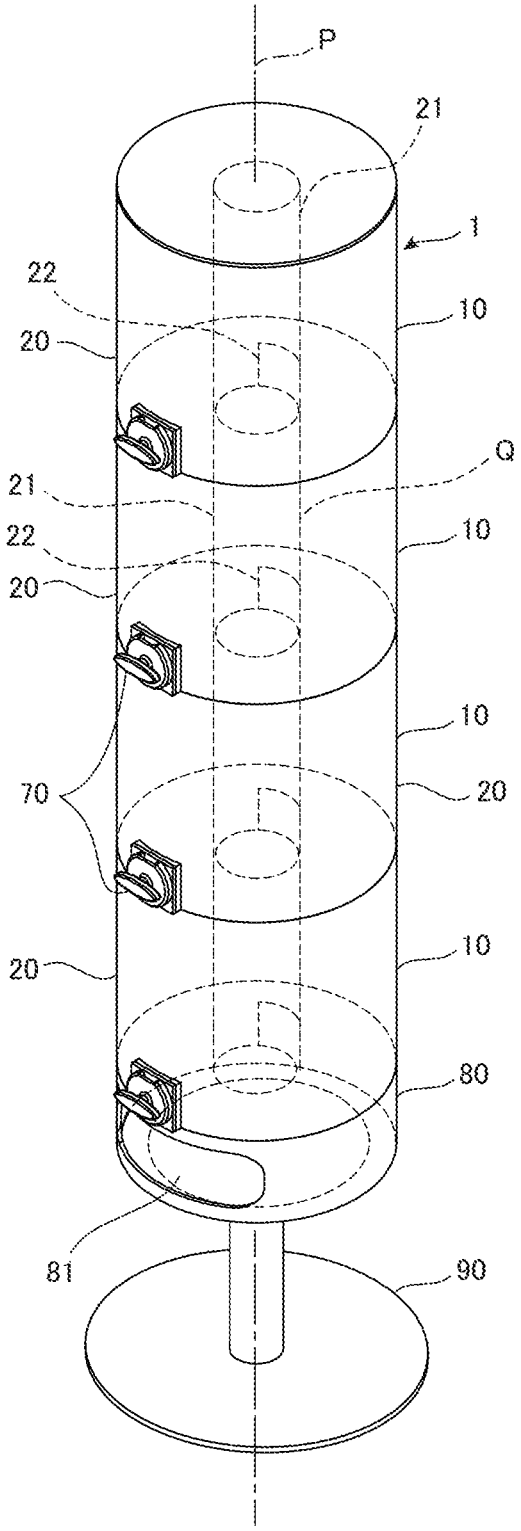
FIG. 1 is a perspective view of an item dispensing device with item ejection units stacked according to the first embodiment of the present invention.
Figure 2:
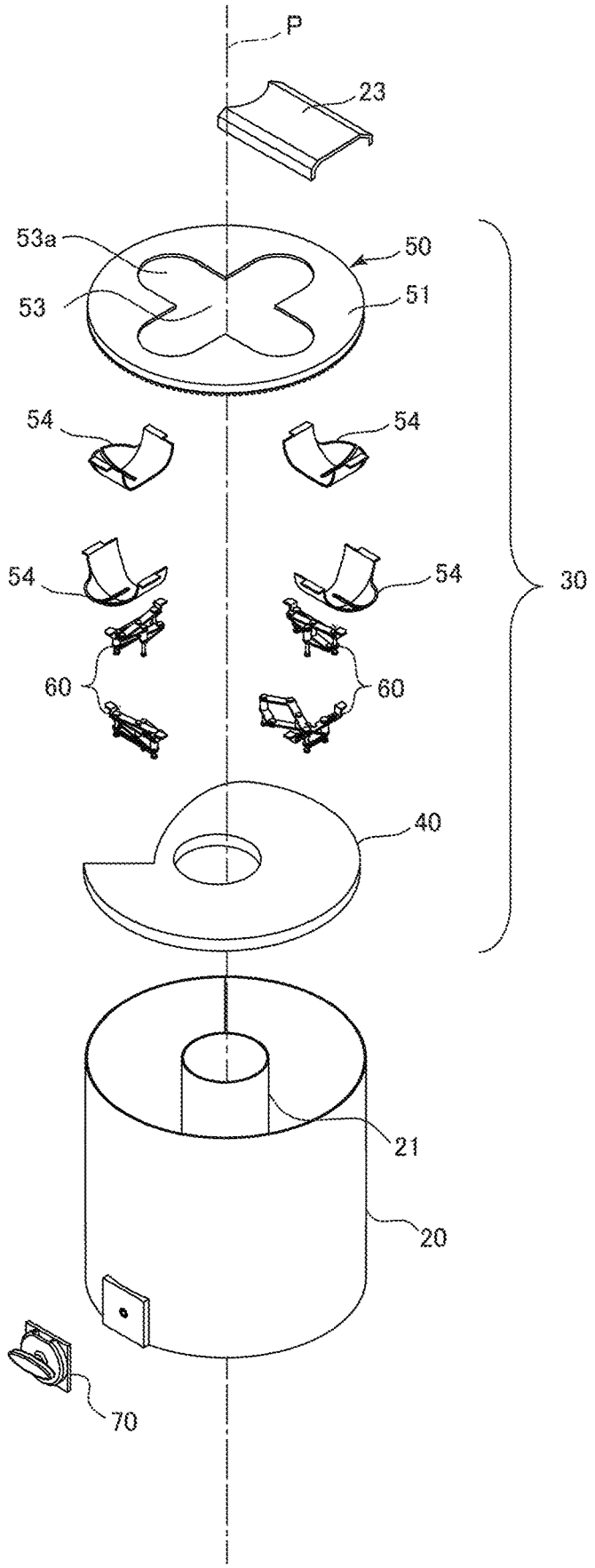
FIG. 2 is an exploded perspective view of the item ejection unit of FIG. 1.
Figure 3:
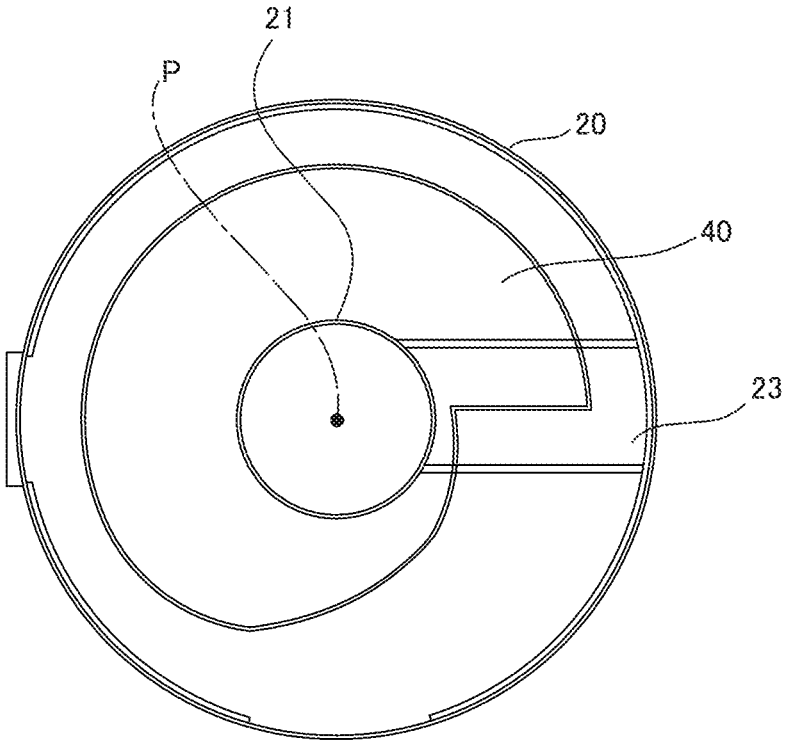
FIG. 3 is a plan view of the item ejection unit of FIG. 1.
Figure 4:
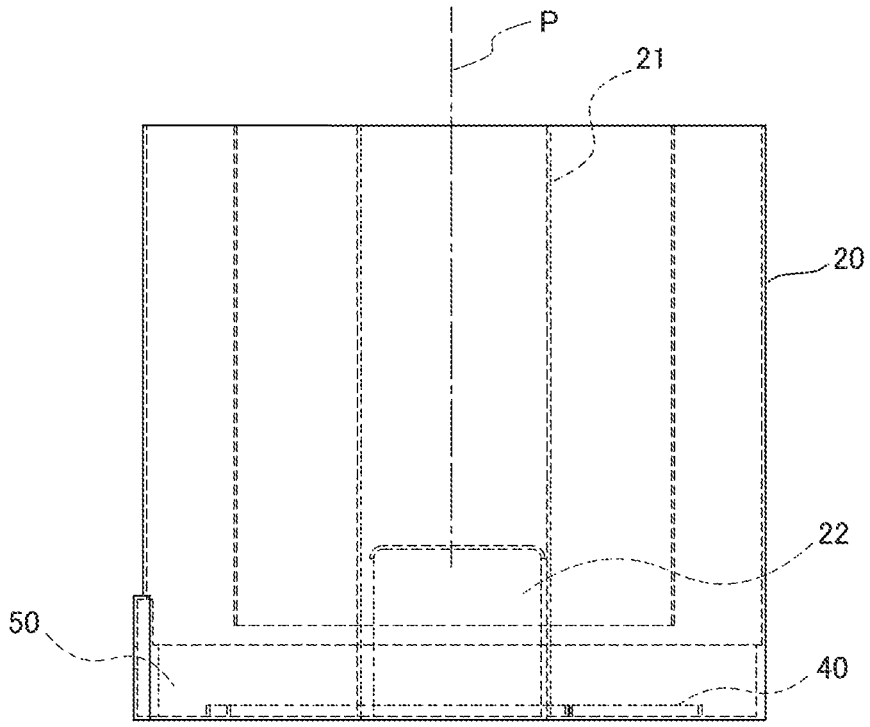
FIG. 4 is a side view of the item ejection unit of FIG. 1.
Figure 5:
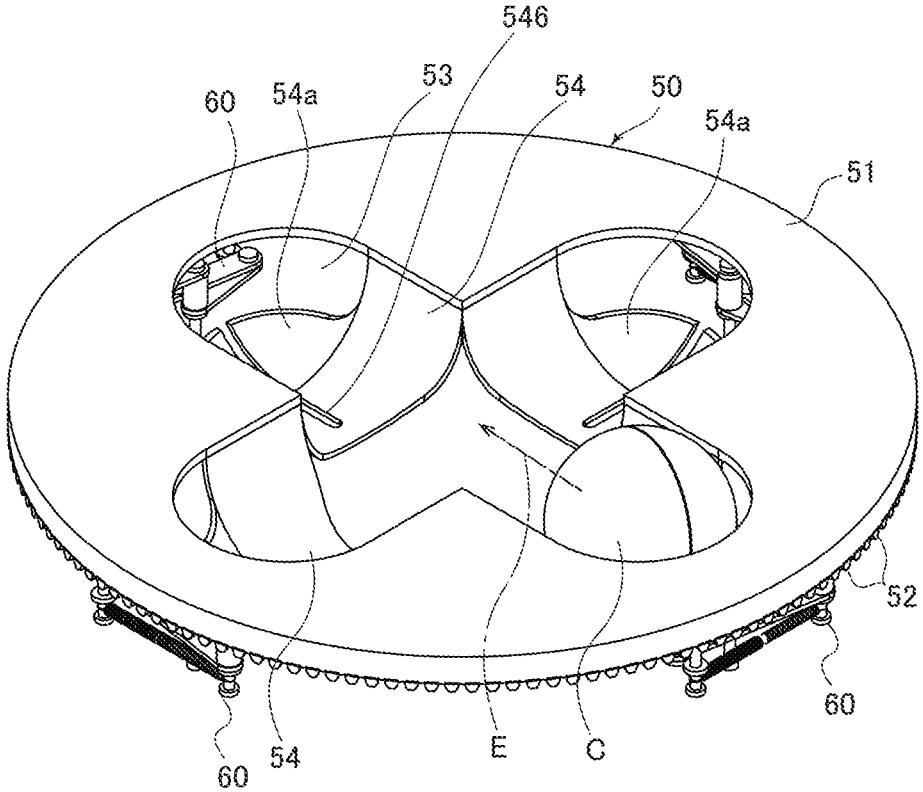
FIG. 5 is a perspective view of a rotor integrated into the item ejection unit of FIG. 1 as viewed from above.
Figure 6:
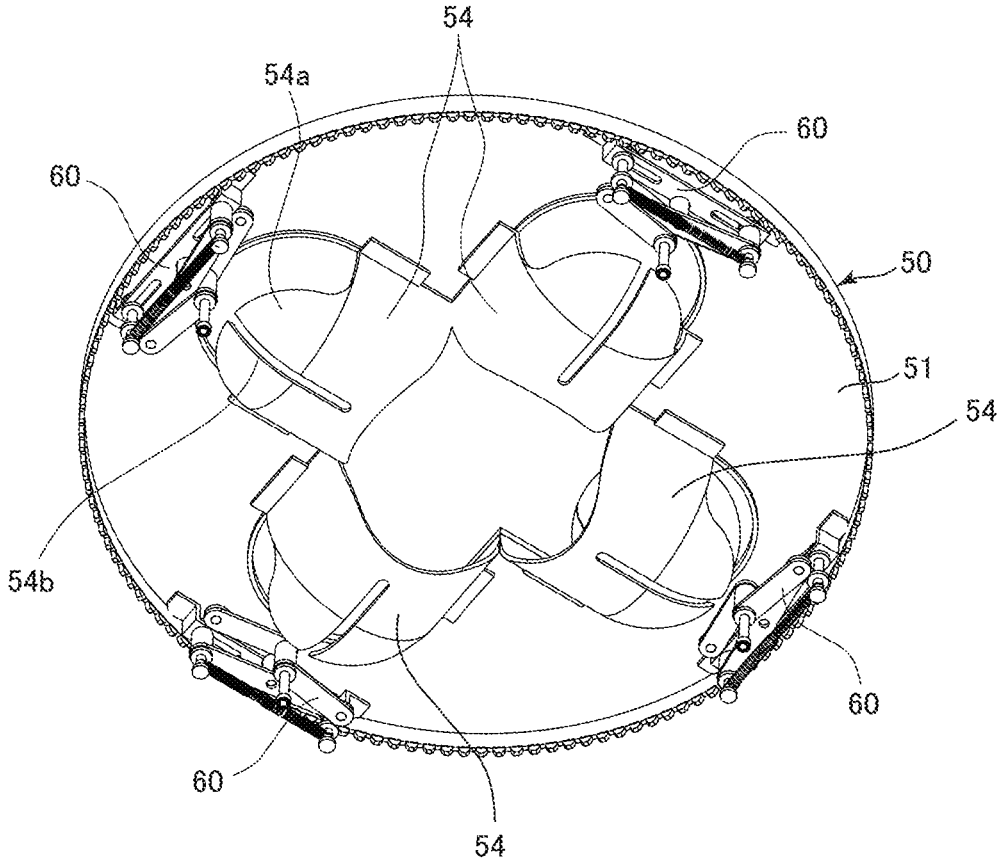
FIG. 6 is a perspective view of the rotor integrated into the item ejection unit of FIG. 1 as viewed from below.
Figure 7:
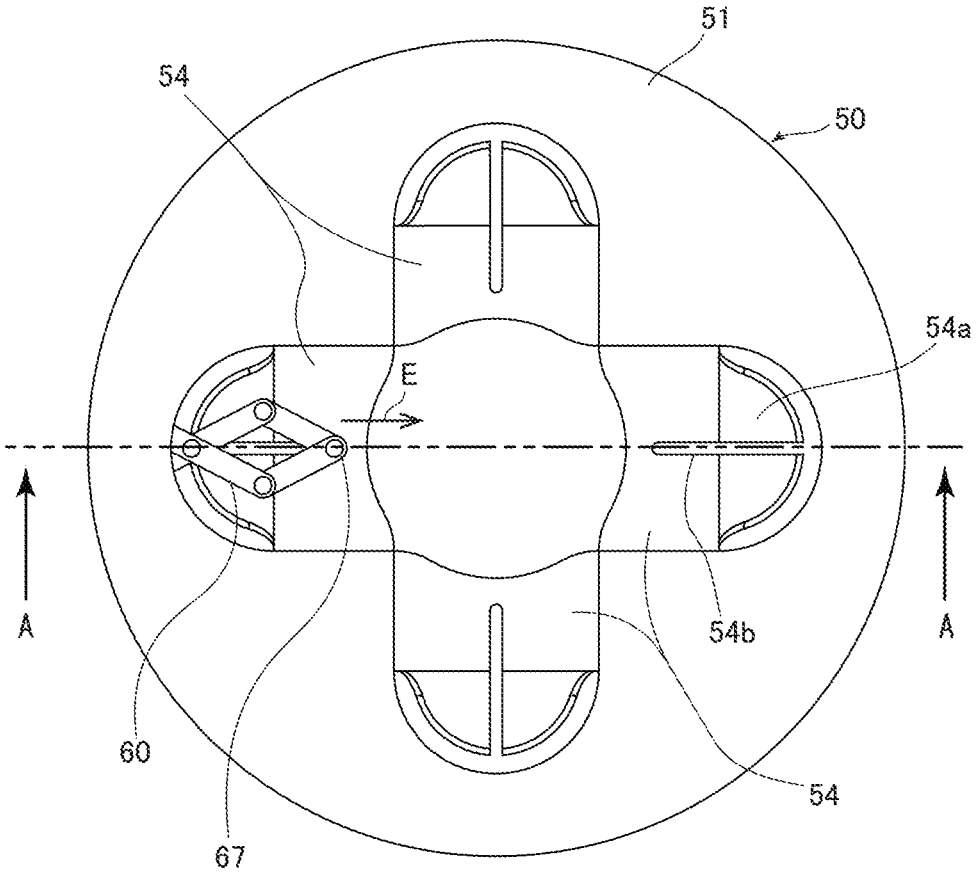
FIG. 7 is a plan view of the rotor integrated into the item ejection unit of FIG. 1.
Figure 8:
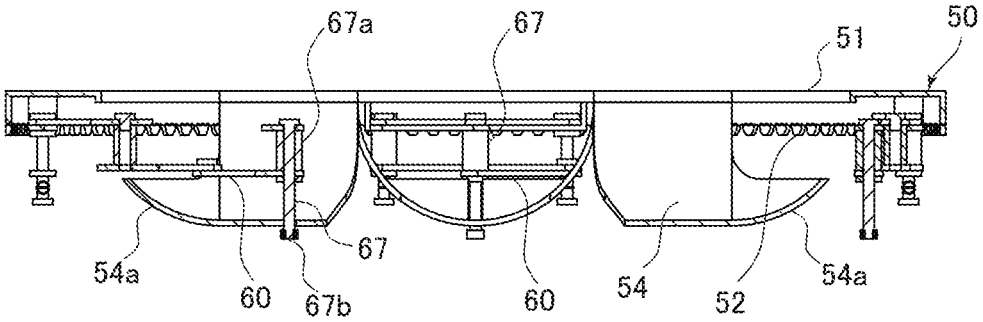
FIG. 8 is a sectional view of the rotor integrated into the item ejection unit of FIG. 1 taken along line A-A in FIG. 7 and viewed in the direction of the arrows.
Figure 9:
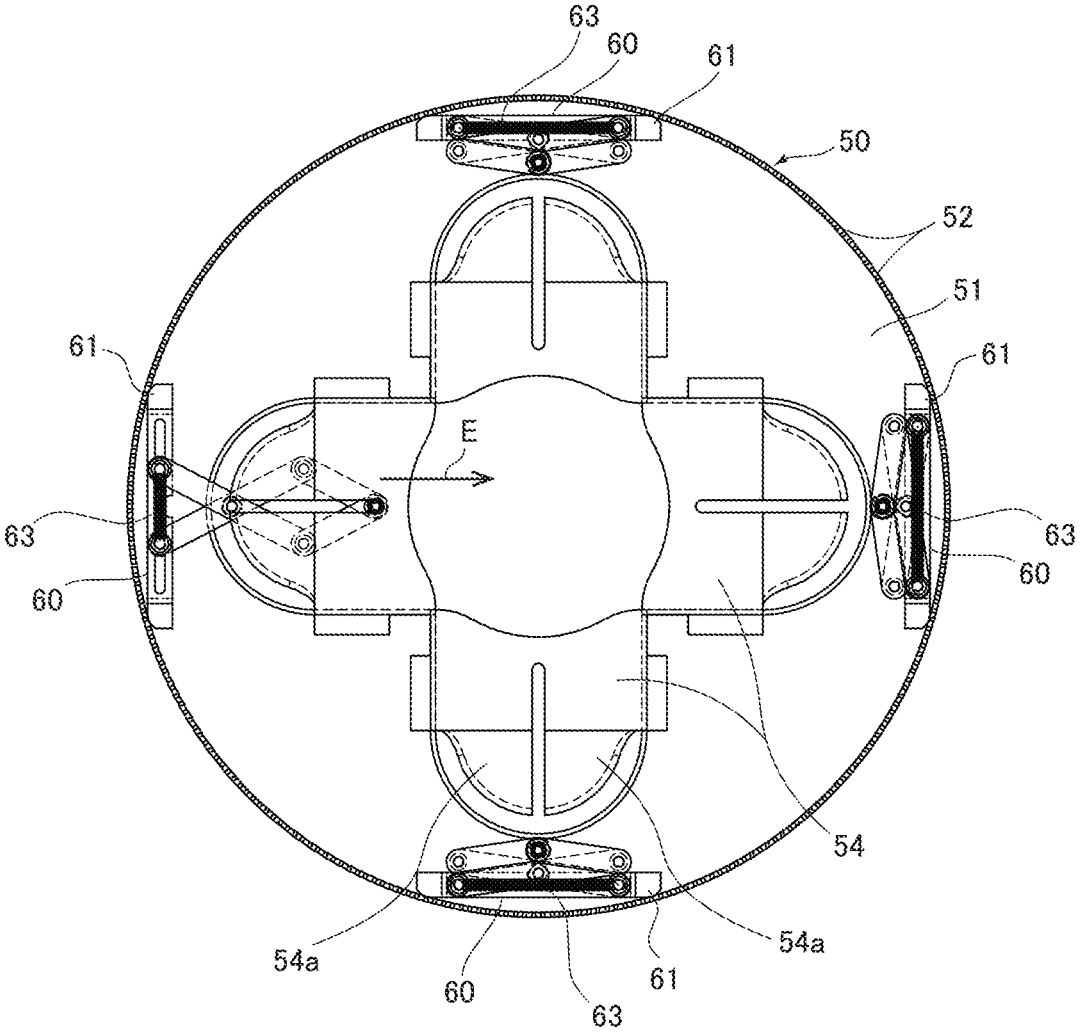
FIG. 9 is a bottom view of the rotor integrated into the item ejection unit of FIG. 1.
Figure 10:
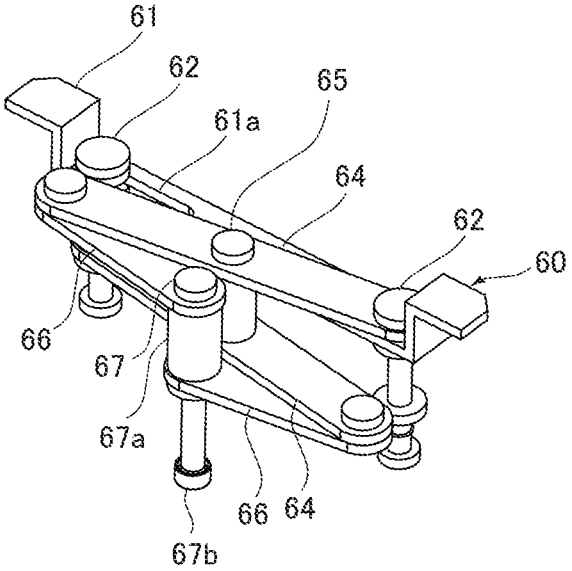
FIG. 10 is a perspective view of a push-into mechanism (retracted) integrated into the rotor of FIG. 9.
Figure 11:
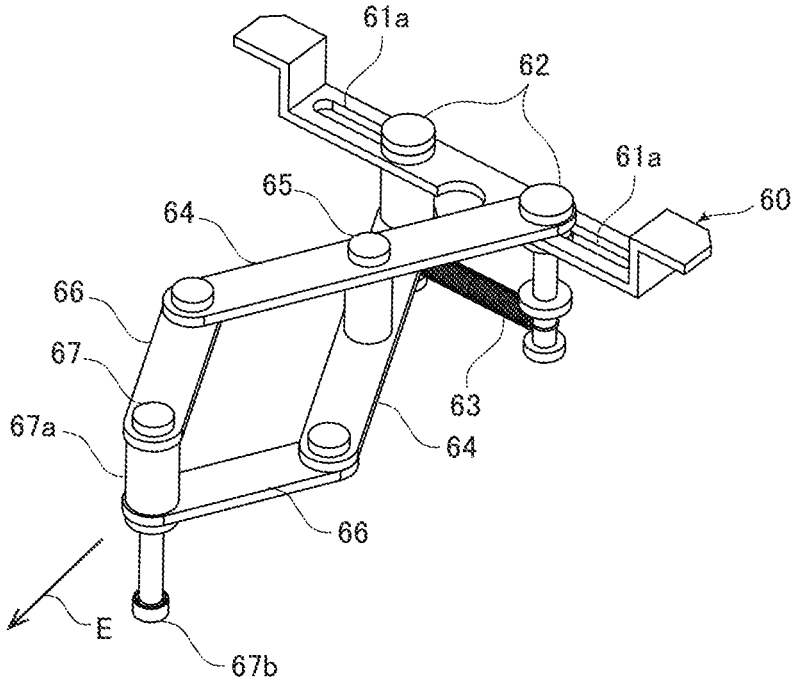
FIG. 11 is a perspective view of the push-into mechanism (extended) integrated into the rotor of FIG. 9.
Figure 12:
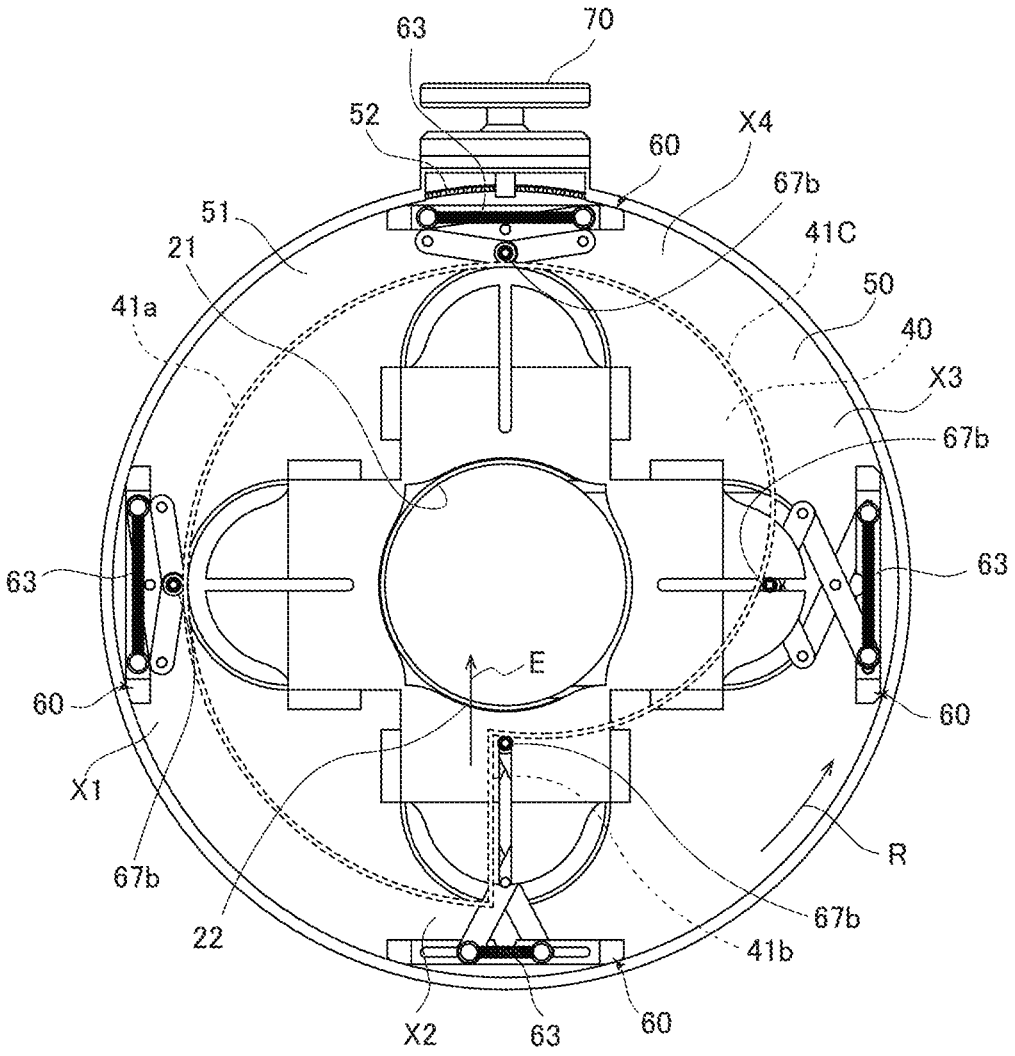
FIG. 12 is a bottom view of the item ejection unit of FIG. 1.
Figure 13:
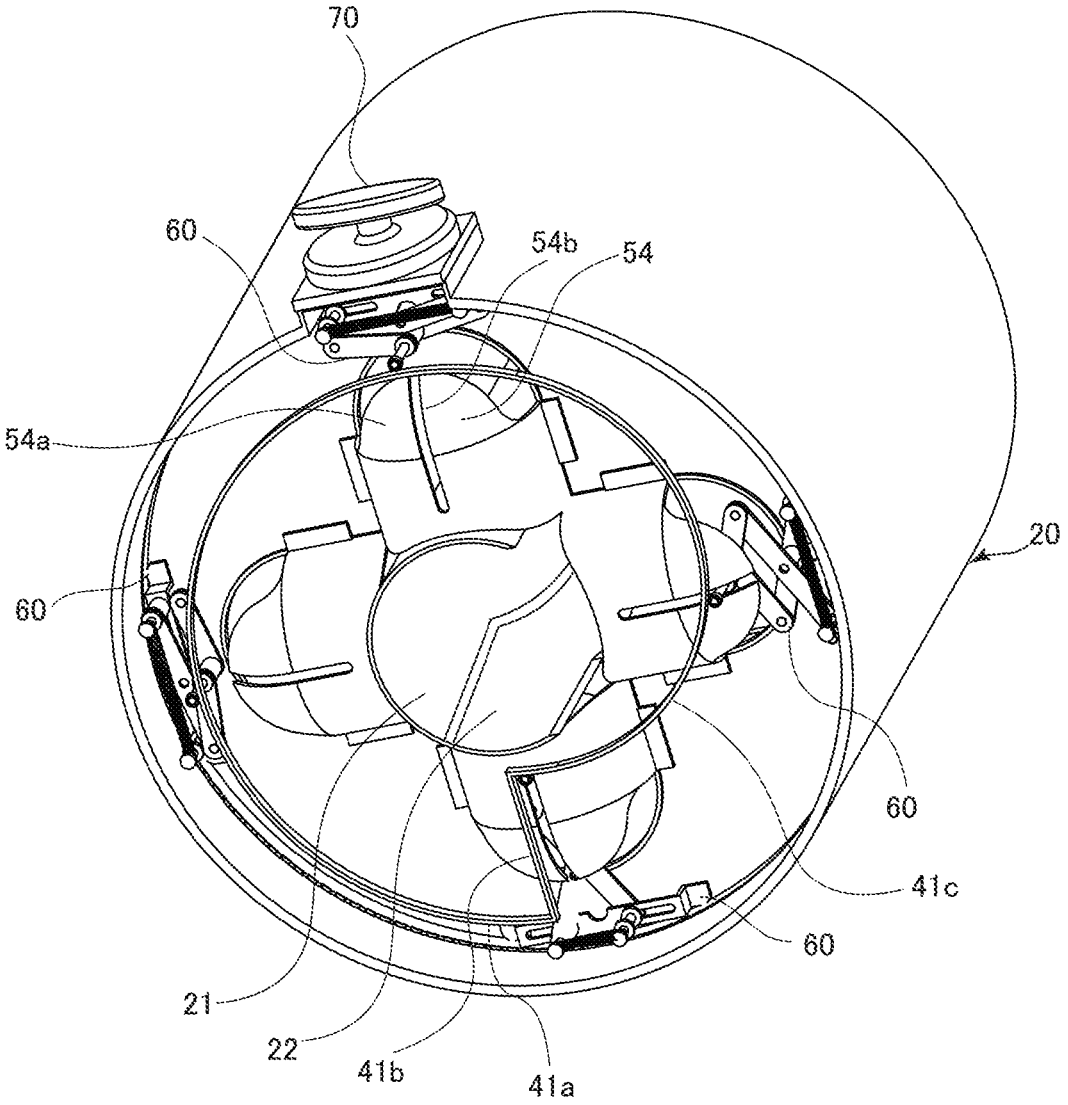
FIG. 13 is a perspective view of the item ejection unit of FIG. 1 as viewed from below.
Figure 14:
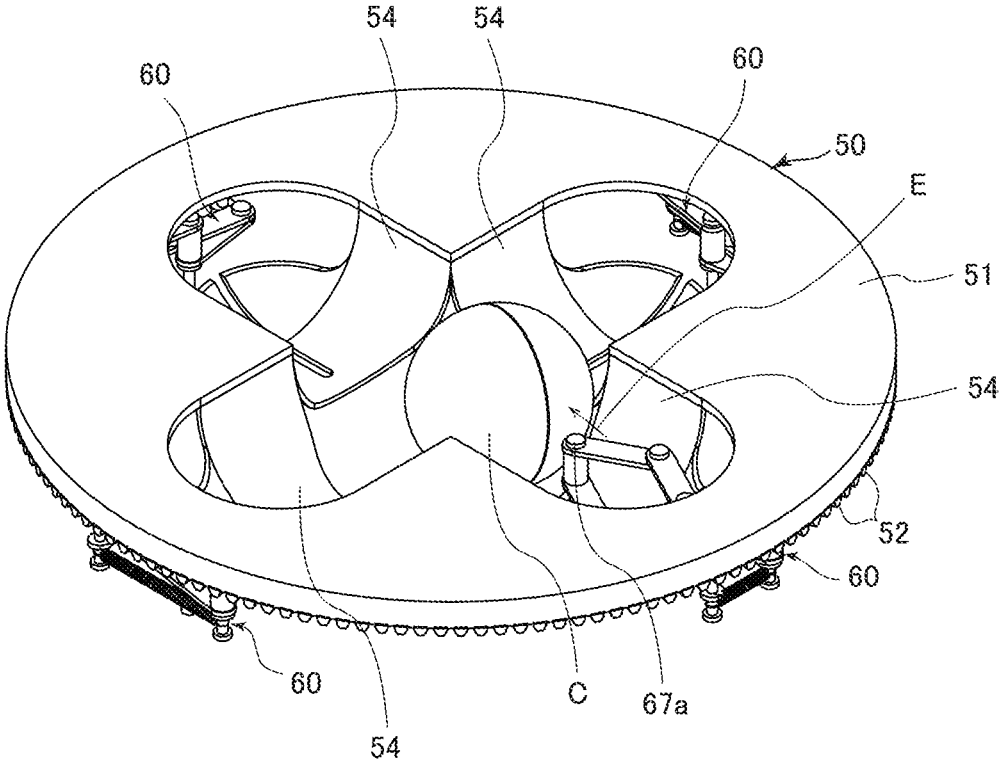
FIG. 14 is a perspective view of the rotor integrated into the item ejection unit of FIG. 1 as viewed from above.

FIGS. 1 to 14 show an item dispensing device 1 with item ejection units 10 stacked according to the first embodiment of the present invention. FIG. 1 shows the item dispensing device 1 with the item ejection units 10 stacked. FIG. 2 is an exploded perspective view of the item ejection unit 10. FIG. 3 shows a position of a cam member 40 in the item ejection unit 10 and FIG. 4 shows a position of a rotor 50 in the item ejection unit 10. FIG. 5 shows the rotor 50 integrated into the item ejection unit 10 as viewed from above and FIG. 6 is a perspective view of the rotor 50 as viewed from below. Furthermore, FIGS. 7 to 9 are a plan view of the rotor 50, a sectional view of the rotor 50 taken along line A-A in FIG. 7 and viewed in the direction of the arrows, a bottom view of the rotor 50, respectively. FIGS. 10 and 11 are perspective views of a push-into mechanism 60 (retracted) integrated into the rotor 50 and of the push-into mechanism 60 (extended) integrated into the rotor 50, respectively. FIG. 12 is a bottom view of the item ejection unit 10 and FIG. 13 is a perspective view of the item ejection unit 10 as viewed from below. FIG. 14 is a perspective view of the rotor 50 integrated into the item ejection unit 10 as viewed from above. Note that while the item dispensing device 1 with a plurality of item ejection units 10 stacked includes a structure for ejecting a capsule (item) C from storage portions with rotation of the rotor 50 provided within each of the item ejection units 10, where the rotation of the rotor 50 is driven by rotation driving structures such as a hand-operated rotation structure in which the rotor 50 rotates according to rotation of a hand-operated handle 70 and a motor-driven rotation structure in which the rotor 50 rotates according to rotation of a motor, the present invention may adopt either structure. In the first and second embodiments, the rotor 50 is described as being rotated with the hand-operated rotation structure. In the drawings, a letter P denotes a central axis, which is set in the vertical direction in the embodiments.

As shown in FIG. 1, the item dispensing device 1 includes four stacked item ejection units 10, an item dispensing unit 80 provided under the item ejection units 10, and a support stand 90 for supporting the entire device. Note that the number of stacked item ejection units 10 is not limited to four. One item ejection unit 10 stacked on the other item ejection unit 10, which are stacked on the item dispensing unit 80, can be used as the item dispensing device. At the core part of the item dispensing device 1, a shared delivery pipe Q for capsules C is provided penetrating throughout the plurality of item ejection units 10. The shared delivery pipe Q is constituted of connected guide pipes 21 of the item ejection units 10. A cylindrical item dispensing unit 80 is connected to a lower end of the shared delivery pipe Q. An item dispensing slot 81 is provided in a side wall of the item dispensing unit 80 so that a customer can take out a purchased capsule C from the item dispensing slot 81.

The item ejection unit 10 includes a bottomed-cylindrical stocker case (storage portion) 20 for storing a plurality of capsules C and an item ejection mechanism 30 provided within the stocker case 20. Also, a rotating handle 70 is provided on an outer wall of the stocker case 20.

A cylindrical guide pipe (guide portion) 21 penetrates through the center axis of the stocker case 20 from a top surface (upper surface) to bottom surface (lower surface) thereof. Inner diameter of the guide pipe 21 is larger than outer diameter of the capsule C. The guide pipes 21 of the plurality of stacked item ejection units 10 communicates one another vertically, thereby forming a single linear cylindrical shared delivery pipe Q. An item ejection port 22 for introducing the capsules C ejected by the item ejection mechanism 30 into the guide pipe 21 is opened in a side wall of the guide pipe 21. A cover 23 is placed above the item ejection port 22 and outward in the radial direction thereof to prevent, after one capsule is ejected, another capsule C located above from coming down to be successively ejected through the item ejection port 22. The cover 23 is, for example, supported by the guide pipe 21 and aligned with the item ejection port 22.

The item ejection unit 10 is characterized in that it has a structure for ejecting the capsules C through the item ejection port 22 of the guide pipe 21. The capsule C dispensed from the stocker case 20 is delivered through the shared delivery pipe Q to the item dispensing unit 80. Note that the stocker case 20 may have a separable structure in which an upper part and lower part can be separated, where the upper part mainly stores the plurality of capsules C, and the lower part houses an item ejection structure constituted of a rotor 50, a push-into mechanism 60, and the like described hereafter.

As shown in FIGS. 2, 3, and 4, the item ejection mechanism 30 includes a plate cam member 40 fixed on the bottom surface side of the stocker case 20 with one plate surface facing upward and the other facing downward, and a rotor 50 placed above the cam member 40 to rotate about the central axis P with respect to the stocker case 20.

The cam member 40 has the function of moving a cam follower 67*b* described hereafter along its outer circumference due to the cam follower 67*b* being pressed against the outer circumference of the cam member 40. As shown in FIG. 2, the cam member 40 includes a circumferential portion 41*a* constituting an approximately ¾ portion of a circle in the circumferential direction, a straight wall 41*b* extended linearly and radially inward from the end of the circumferential portion 41*a*, and a spiral portion 41*c* extending from the end of the straight wall 41*b* to the starting point of the circumferential portion 41*a* with its radius being gradually increased. The straight wall 41*b* is aligned with the item ejection port 22.

As shown in FIGS. 5 and 6, the rotor 50 includes a circular plate (circular disk) 51 having an opening portion 53. The outer radius of the circular disk 51 is slightly shorter than the radius of the stocker case 20, thereby preventing capsules C from falling into a gap between the outer peripheral surface of the circular disk 51 and the inner wall surface of the stocker case 20. Note that the outer circumferential shape of the rotor 50 may be a polygon such as a rectangle, hexagon, or the like with rounded corners as long as the rotor 50 can rotate within the stocker case 20 and unless the capsule C falls into the gap between the outer peripheral surface of the rotor 50 and the inner wall surface of the stocker case 20. For example, when the outer circumferential shape of the rotor 50 is a rectangle with rounded corners, a distance from the center of that rounded-rectangular plate to its corners of the outer circumference is configured to be slightly shorter than the radius of the stocker case 20.

A driven gear 52 is formed on the outer edge of a lower surface of the circular disk 51. The driven gear 52 is meshed with a driving gear attached to a rotating shaft of the rotating handle 70, either directly or via a speed reducer or the like. Thus, the rotor 50 rotates with rotation of the rotating handle 70.

The opening portion 53 of the circular disk 51 is in the shape with substantially-semicircular item holders 53*a* shifted by 90 degrees with respect to one another in the circumferential direction about the center of the circular disk 51. Note that the shape of the item holder 53*a* is not limited to a semicircle. For example, the shape may be a polygon such as a rectangle, hexagon, or the like. The inner wall of the item holder 53*a* is formed slightly larger than the outer diameter of the capsule C. A saucer-shaped tray 54 for receiving the capsule C held in the item holder 53*a* is placed under each of the item holders 53*a*. Note that a structure for receiving the capsule C held in the item holder 53*a* is herein a structure with four item holders 53*a* provided with the corresponding four trays 54, respectively, but not limited thereto. For example, the four trays 54 can be substituted with a single circular tray sloping downward in the outward direction at any angle in a range of zero degree (horizontal) to 10 degree.

In the tray 54, a wall surface 54*a* is formed on the outer diameter side to prevent capsule C held therein from moving radially outward, whereas no wall surface is provided on the inner diameter side in order to allow the capsule C to be selectively ejected through the item ejection port 22.

As shown in FIGS. 7, 8, and 9, a bottom plate of the tray 54 is kept in the state of sloping downward in the outward direction at any angle in the range of zero degree (horizontal) to 10 degree. Therefore, the capsule C usually rotates with the rotor 50 while being held in the item holder 53*a*. A linear notch groove 54*b* is formed in the bottom plate of the tray 54. A cam follower shaft 67 described hereafter is reciprocably guided in the notch groove 54*b*. Inside dimensions of the tray 54 are larger than the outer diameter of the capsule C, and the tray 54 has the function of transporting the capsule C held in the tray 54 in the rotary direction. Also, the central axis of the tray 54 is formed along the radial direction from the central axis P. It is referred to as a push-into direction E for convenience. An extending direction of the notch groove 54*b* described above coincides with the push-into direction E.

A push-into mechanism 60 is disposed on the radially-outward side of each tray 54. The push-into mechanism 60 is provided on the outer circumferential side of a lower surface of the circular disk 51 and rotates with the rotor 50. As shown in FIGS. 10 and 11, the push-into mechanism 60 typically includes a pantograph mechanism and an elastic member for driving the pantograph mechanism. The push-into mechanism 60 includes a bracket 61 attached to the back surface of the circular disk 51 and inside the outer circumference thereof. A pair of grooves 61*a* is formed in the bracket 61, extending in the tangential direction of the circular disk 51. A pair of supporting shafts 62 is slidably placed in the grooves 61*a*, extending in parallel with the central axis P. A tension spring 63 is disposed as the elastic member in a lower part of the pair of supporting shafts 62 to energize the pair of supporting shafts 62 in the direction that causes the supporting shafts 62 to approach each other.

Proximal ends of a pair of actuating arms 64 are swingably attached to the pair of supporting shafts 62, respectively, and the actuating arms 64 are swingably connected with each other via a pin 65 at the center. Furthermore, proximal ends of operating arms 66 are swingably connected to tip portions of the pair of actuating arms 64, respectively, and tip portions of the operating arms 66 are swingably connected with each other via the cam follower shaft 67. That is, the cam follower shaft 67 is always being energized toward the central axis P by the tension spring 63.

A pressing portion 67*a* and the cam follower 67*b* made up of a bearing constitute an upper part and lower part of the cam follower shaft 67, respectively. That is, while the cam follower 67*b* is moving along the cam member 40, the pressing portion 67*a* moves within the tray 54 concurrently with the cam follower shaft 67 going through the notch groove 54*b*.

A method for dispensing capsules C with the item dispensing device 1 configured in such a way will be described with reference to FIGS. 12 to 14. Note that the cam member 40 is indicated in outline with two-dot chain lines in FIGS. 12 and 13. When a customer turns the rotating handle 70, turning force of the rotating handle 70 causes the rotor 50 to rotate in the direction of the arrow R via the gear 52. As the rotor 50 rotates, the push-into mechanism 60 rotates as well, resulting in the cam follower 67*b* provided at a tip of the push-into mechanism 60 moving in the direction of the arrow R while being pressed against an outer peripheral surface of the cam member 40.

The description begins with a case in which any one of the four push-into mechanisms 60 is located in the direction of X1 in FIG. 12. At this position, the cam follower 67*b* of the push-into mechanism 60 abuts the circumferential portion 41*a* and the tension spring 63 is kept extended. When the rotating handle 70 is turned by the customer as described above, the rotor 50 rotates, and the cam follower 67*b* moves in the direction of the arrow R and reaches an end of the circumferential portion 41*a*, i.e., the position X2. At the position X2, not being pushed outward by the circumferential portion 41*a*, the cam follower 67*b* is energized in a moment toward the central axis P along the straight wall 41*b* by the tensile force of the tension spring 63.

On the other hand, the pressing portion 67*a* located within the tray 54 acts integrally with the cam follower 67*b*, so the capsule C held within the tray 54 is also energized toward the central axis P as shown in FIG. 14. Since the item ejection port 22 is provided at that position, the capsule C is pushed into the guide pipe 21 and delivered through the shared delivery pipe Q to the item dispensing unit 80. Note that since the cover 23 is provided above the position X2, any other capsules C are not held in the item holder 53*a*.

The next purchase operation causes the rotor 50 to rotate and move toward the position X3. The cam follower 67*b* is gradually pushed outward along the spiral portion 41*c*. The further next purchase operation causes the rotor 50 to rotate and move toward the position X4. The cam follower 67*b* reaches the starting point of the circumferential portion 41*a* and the push-into mechanism 60 becomes in a fully retracted position. The still further next purchase operation causes the rotor 50 to rotate and return to the position X1. The capsule C delivered to the item dispensing unit 80 is taken out from the item dispensing slot 81 by the customer. In this way, the push-into mechanism 60 and cam member 40 constitute an energizing mechanism for energizing the capsule C held in the item holder 53*a* of the rotor 50 radially inward and pushing out the capsule C substantially horizontally to the item ejection port 22 when the opening of that item holder 53*a* is aligned with the item ejection port 22.

Note that although a pantograph mechanism configured to be energized radially inward by an elastic member is adopted here as the push-into mechanism 60, the structure for the push-into mechanism 60 is not limited thereto as long as the push-into mechanism 60 can push out the capsule C held in the item holder 53*a* of the rotor 50 radially inward when the opening of the item holder 53*a* is aligned with the item ejection port 22. For example, the push-into mechanism 60 may be constituted of a slider mechanism and an elastic member for energizing the slider mechanism radially inward.

Considering a single item ejection unit 10, being provided in a side wall of the guide pipe 21 inside the stocker case 20, the item ejection port 22 needs not to be provided under the stocker case 20, so the entire device can be configured with approximately the same height as that of stocker case 20. This makes it possible to increase the number of stored items without increasing the height of the item ejection unit 10. Also, when an item dispensing device 1 is configured with a plurality of item ejection units 10 stacked, the height of the entire device can be reduced.

Also, with this energizing mechanism, the tension spring 63 in the extended state is released in a moment and the instantaneous repulsive force thereof can cause the capsule C to be forced out in the horizontal direction toward the central axis P with great force. Thus, not only spherical capsules C, but also ellipsoidal, polygonal or other non-spherical capsules C can be ejected from the item dispensing unit 80 via the item ejection port 22 and shared delivery pipe Q without unexpected stops. Furthermore, being provided with the tray 54 for receiving the capsule C enables the device to deal with capsules of various sizes. For example, even when a capsule is small, the size of the tray 54 can be changed according to the size of the capsule C so that one capsule C is held in each item holder 53*a*, so one capsule C can be ejected at a time.

Variation

Figure 15:
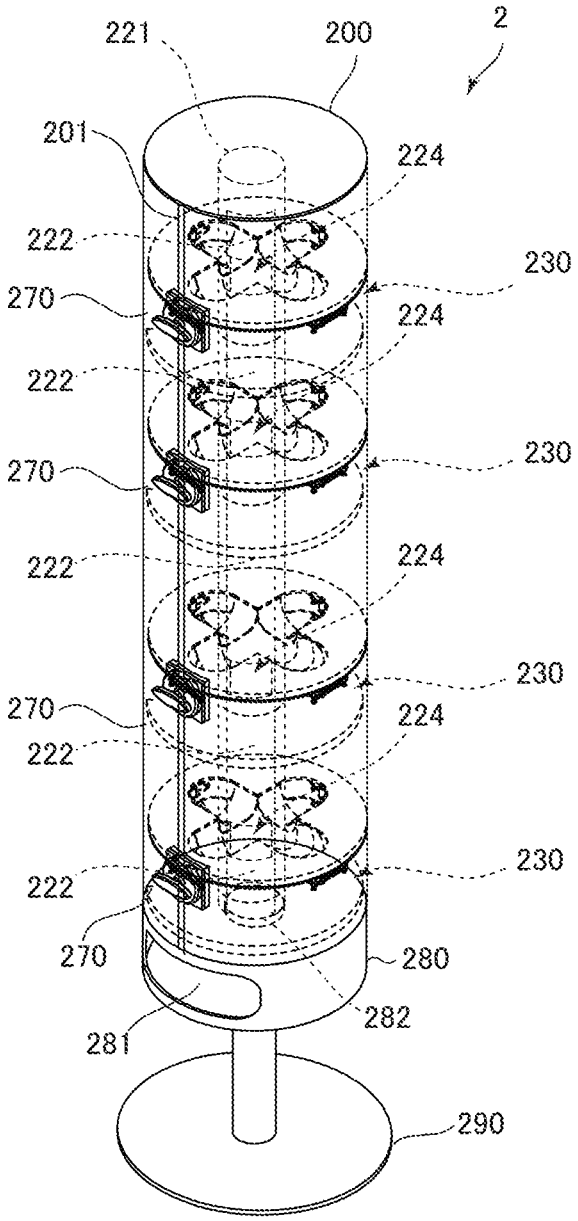
FIG. 15 is a perspective view of an item dispensing device according to a variation of the first embodiment of the present invention.
Figure 16:
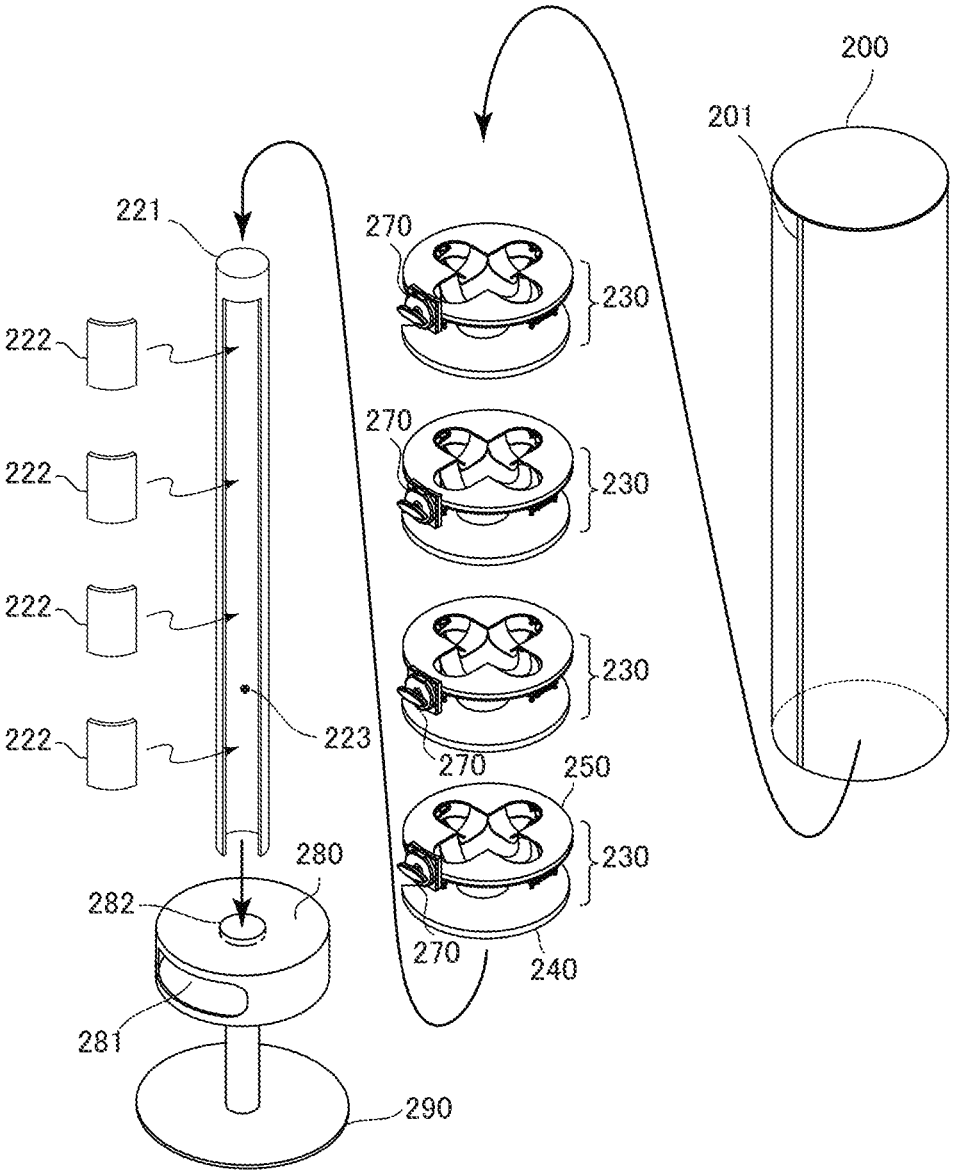
FIG. 16 is an exploded perspective view of the item dispensing device of FIG. 15.

Although in the first embodiment, the item dispensing device 1 is configured with the item ejection units 10 stacked, each of the item ejection units 10 including the stocker case 20 and item ejection mechanism 30, the device may be configured with a single stocker case 20 within which a plurality of item ejection mechanisms 30 are distributed along the central axis thereof. FIG. 15 is a perspective view of an item dispensing device 2 according to a variation of the first embodiment of the present invention. FIG. 16 is an exploded perspective view of the item dispensing device 2 according to the variation of the first embodiment of the present invention.

As shown in FIGS. 15 and 16, the item dispensing device 2 according to the variation of the first embodiment includes a cylindrical stocker case 200, a plurality of circular item ejection mechanisms 230 distributed within the stocker case 200, a cylindrical shared delivery pipe 221 penetrating the plurality of item ejection mechanisms 230, wherein a plurality of side wall portions corresponding to the plurality of item ejection mechanisms 230 are opened as a plurality of item ejection ports 224, an item dispensing unit 280 connected to a lower end of the shared delivery pipe 221 and provided with a dispensing slot 281 from which items are taken out, and a support stand 290 for supporting the entire device.

The item ejection mechanism 230 is similarly configured to the item ejection mechanism 30 in the first embodiment. A rotor 250 of the item ejection mechanism 230 is provided in a rotatable manner about the shared delivery pipe 221 at any position thereof. A cam member 240 of the item ejection mechanism 230 is fastened to the shared delivery pipe 221 with a fastening mechanism such as a screw. That is, a space inside a single stocker case 200 is divided into a plurality of stocker spaces (compartments) by the plurality of item ejection mechanisms 230. Each of the item ejection mechanisms 230 selectively ejects a capsule C stored in a stocker space between that item ejection mechanism 230 and the item ejection mechanism 230 directly above or the upper surface of the stocker case 200.

A slit 223 for the item ejection ports is cut out in a side wall of the shared delivery pipe 221 along the axial direction of the shared delivery pipe 221. The width of the slit 223 is slightly larger than the diameter of the capsule C. With the slit 223 partially covered with a covers 222, a plurality of side wall portions corresponding to the plurality of item ejection mechanisms 230 are formed as the plurality of item ejection ports 224, so that only capsules ejected from each of the item ejection mechanisms 230 can be introduced through the item ejection ports 224 into the shared delivery pipe 221.

In a side wall of the stocker case 200, a slit for handle 201 is provided linearly along the axial direction. A plurality of rotating handles 270 are fitted into the slit for handle 201. The rotating handle 270 is fastened with a fastening mechanism such as a screw at a position where the rotating handle 270 meshes with a driven gear of the rotor 250 of the item ejection mechanism 230.

With this configuration, the item dispensing device 2 according to the variation of the first embodiment achieves similar effects to those of the first embodiment, so that the height of the entire item dispensing device 2 can be reduced. Further, in contrast to the fixed capacity of each of the stacked item ejection units 10 in the first embodiment, with the structure in which a plurality of item ejection mechanisms 230 are distributed within the single stocker case 200, a ratio of the capacity allocated to each of the plurality of stocker spaces corresponding to each of the item ejection mechanisms 230 can be changed while the entire item dispensing device 2 has a fixed capacity. Thus, the capacity of each stocker space can be changed only by adjusting the position and quantity of the item ejection mechanisms 230, so the capacity of each stocker space can be changed according to the quantity of stock or the like, and the usage efficiency of the storage capacity of the device can be improved.

Example 2

Figure 17:
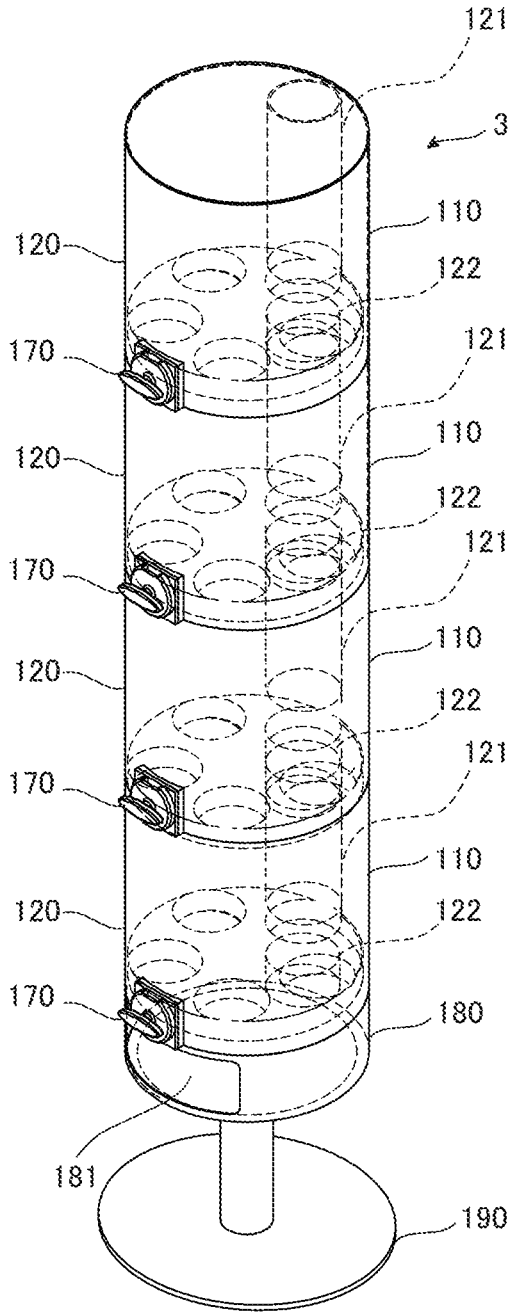
FIG. 17 is a perspective view of an item dispensing device with item ejection units stacked according to the second embodiment of the present invention.
Figure 18:
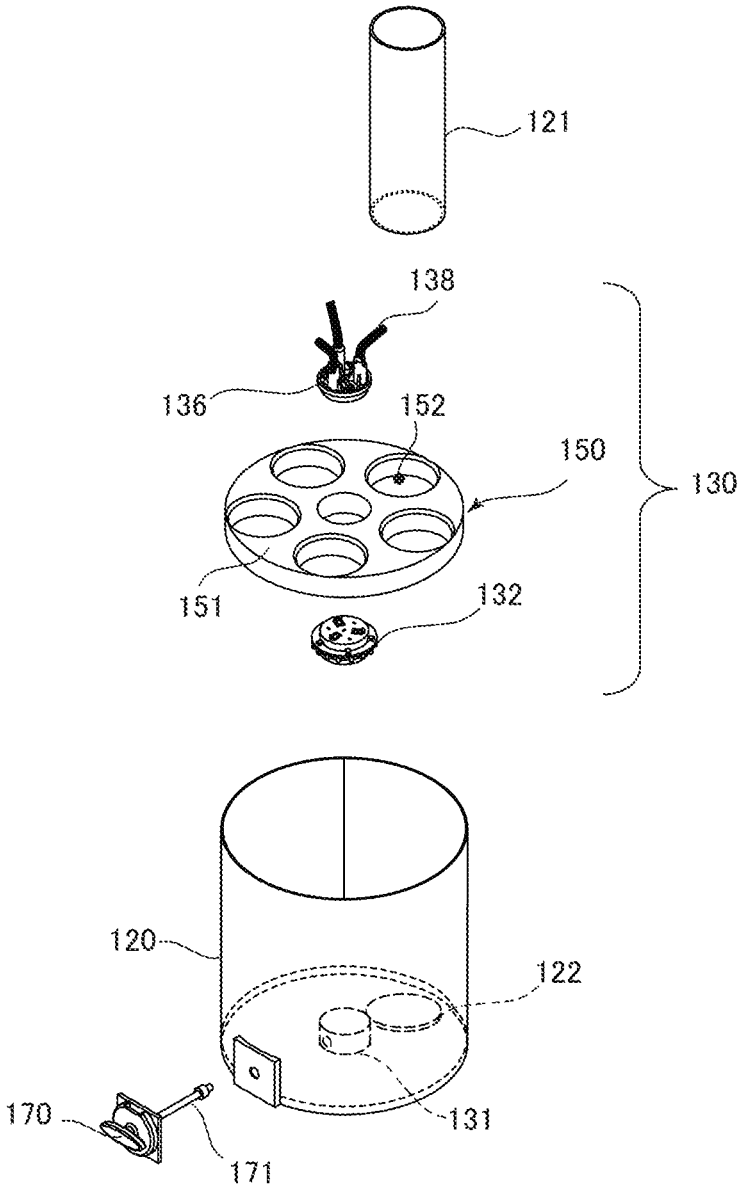
FIG. 18 is an exploded perspective view of the item ejection unit of FIG. 17.
Figure 19:
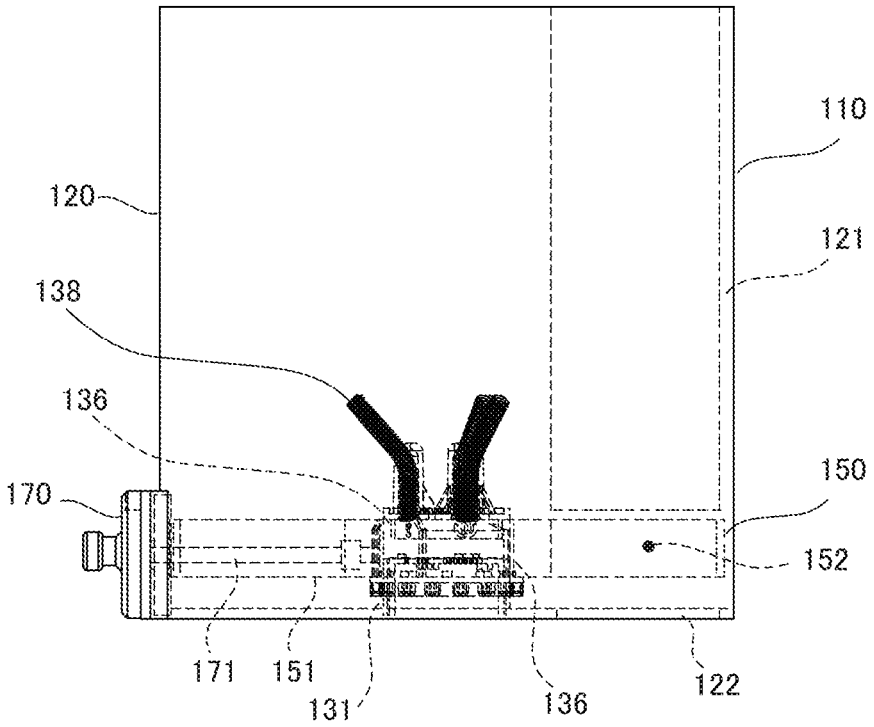
FIG. 19 is a side view of the item ejection unit of FIG. 17.
Figure 20:
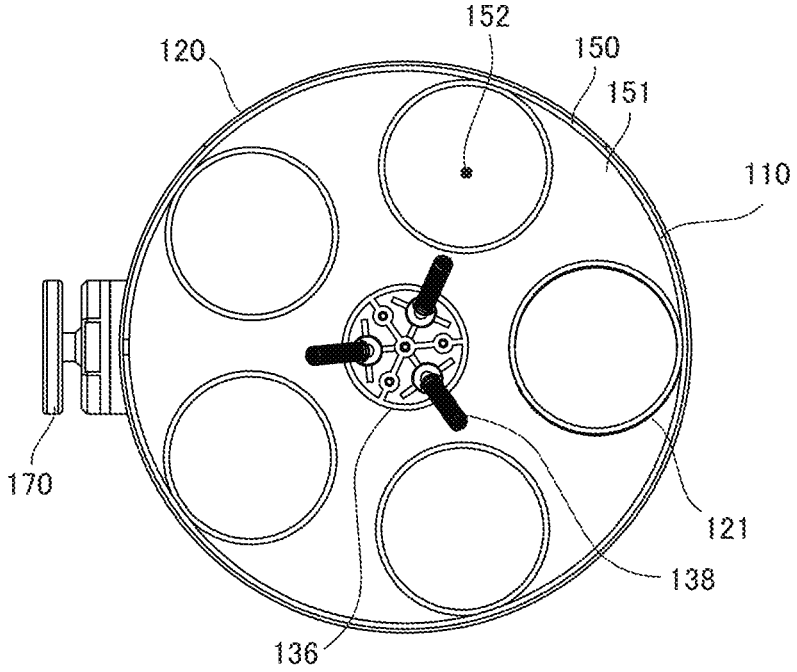
FIG. 20 is a plan view of the item ejection unit of FIG. 17.
Figure 21:
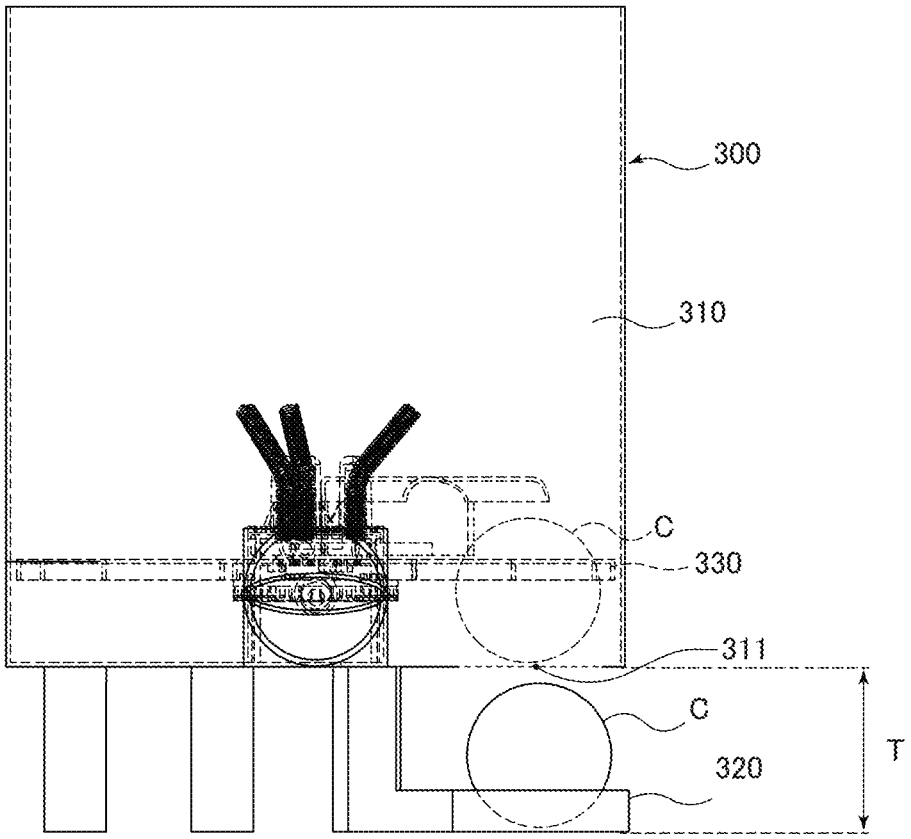
FIG. 21 is a side view of a typical item dispensing device.

FIGS. 17 to 19 show an item dispensing device 3 with item ejection units 110 staked according to the second embodiment of the present invention. FIG. 17 shows the item dispensing device 3 with item ejection units 110 stacked. FIG. 18 is an exploded perspective view of the item ejection units 110. FIG. 19 is a side view indicating a position of a rotor 150 integrated into the item ejection unit 110. FIG. 20 is a plan view of the rotor 150 integrated into the item ejection unit 110. Note that the item ejection units 110 may be stacked into a single item dispensing device 3 as shown in FIG. 17 or used alone.

As shown in FIG. 17, the item dispensing device 3 includes four stacked item ejection units 110, an item dispensing unit 180 provided under the item ejection units 110, and a support stand 190 for supporting the entire device. Note that the number of stacked item ejection units 110 is not limited to four. A single item ejection unit 110 stacked on the item dispensing unit 180 may be installed on a floor surface.

As shown in FIG. 18, the item ejection unit 110 includes a bottomed-cylindrical stocker case 120 for storing a plurality of capsules C containing items, an item ejection mechanism 130 provided within the stocker case 120, and a guide pipe 121 for introducing capsules C ejected from the item ejection units 110 placed above.

A circular item ejection port 122 with a diameter slightly larger than that of the capsule C is formed in a bottom surface (lower surface) of the stocker case 120. The item ejection port 122 is opened at any position that can be aligned with an item holder 152 of the rotor 150 described hereafter. The guide pipe 121 is typically a cylinder with the same inner diameter as that of the item ejection port 122, and provided to be aligned with the item ejection port 122. An upper end of the guide pipe 121 penetrates a top surface (upper surface) of the stocker case 120 while a lower end thereof is placed above the rotor 150, i.e., at a position higher than the bottom surface of the stocker case 120 by a height slightly larger than the diameter of the capsule C.

The item ejection mechanism 130 includes the rotor 150. As shown in FIG. 20, the rotor 150 includes a circular plate 151 with an outer diameter slightly shorter than an inner diameter of the stocker case 120, five circular item holders 152 provided intermittently along the circumferential direction of the circular plate 151, and a circular fitting hole 153 provided in the center of the circular plate 151 and into which a gear 132 is fitted. The circular plate 151 is placed such that the outer peripheral surface thereof is spaced apart from the inner wall surface of the stocker case 120 with a small gap provided therebetween. The item holder 152 is sized larger than the outer diameter of the capsule C. An upper part of the gear 132 is fitted into the fitting hole 153 and fastened with a cap 136. A plurality of, three in this case, stirrers 138 for stirring the capsules C within the stocker case 120 are mounted on the cap 136. The stirrers 138 includes, for example, coil springs. The gear 132 is attached to a base 131 in a rotatable manner about the vertical axis, the base 131 being provided at the center of the bottom of the stocker case 120. A rotating shaft 171 for rotating the gear 132 is inserted into a lower part of the gear 132. The rotating shaft 171 is connected to a rotating handle 170. When the rotating handle 170 is rotated by the customer, the rotor 150 is rotated with the gear 132.

As shown in FIG. 19, the rotor 150 is placed at a position higher than the bottom surface of the stocker case 120 by a height smaller than the diameter of the capsule C. Thus, the capsule C held in the item holder 152 is transported to the item ejection port 122 while rolling or sliding on the bottom surface of the stocker case 120. For example, a capsule C transported to the item ejection port 122 with rotation of the rotor 150 in the uppermost one of the four stacked item ejection units 110 falls into the item ejection port 122, passes through the guide pipes 121, item holders 152, and item ejection ports 122 of other item ejection units 110, and is delivered to the item dispensing unit 180. In this way, the guide pipe 121, item holder 152, and item ejection port 122 of each of the plurality of stacked item ejection units 110 constitute a shared delivery pipe for delivering the capsule ejected from each of the plurality of item ejection units 110 to the item ejection unit 110.

With the item dispensing device 3 configured in such a way according to the second embodiment, the capsule ejected from each of the plurality of stacked item ejection units 110 is delivered through the shared delivery pipe to the item dispensing unit 180 in a lower part of the device. That is, a capsule delivery passage needs to be formed neither individually per item ejection unit 110 nor outside, so the height and width of the entire item dispensing device 3 with the plurality of item ejection units 110 stacked can be reduced.

It should be appreciated that the present invention can be applied to various types of item dispensing devices and item ejection units, but not limited to the embodiments described above.

REFERENCE SIGNS LIST

1 . . . item dispensing device; 10 . . . item ejection unit; 20 . . . stocker case; 21 . . . guide pipe; 22 . . . item ejection port; 23 . . . cover; 30 . . . item ejection mechanism; 40 . . . cam member; 41*a* . . . circumferential portion; 41*b* . . . straight wall; 41*c* . . . spiral portion; 50 . . . rotor; 51 . . . circular disk; 52 . . . gear; 53 . . . opening portion; 53*a* . . . item holder; 54 . . . tray; 54*a* . . . wall surface; 54*b* . . . notch groove; 60 . . . push-into mechanism; 61 . . . bracket; 61*a* . . . groove; 62 . . . supporting shaft; 63 . . . tension spring; 64 . . . actuating arm; 65 . . . pin; 66 . . . operating arm; 67 . . . cam follower shaft; 67*a* . . . pressing portion; 67*b* . . . cam follower; 70 . . . rotating handle; 80 . . . item dispensing unit; 90 . . . support stand; P . . . central axis; Q . . . shared delivery pipe.

The invention claimed is:

1. An item dispensing device comprising:

a plurality of stacked item ejection units;

a cylindrical shared delivery pipe penetrating throughout the plurality of stacked item ejection units, wherein a plurality of side-wall portions corresponding to the plurality of item ejection units are opened as a plurality of item ejection ports; and an item dispensing unit connected to a lower end of the shared delivery pipe and provided with an item dispensing slot, wherein the item ejection unit includes:

a cylinder for storing a plurality of items;

a circular rotor rotatably provided in a lower part of, and coaxially with the cylinder, wherein the rotor has an opening portion in which a plurality of substantially semicircular item holders for holding one item in each holder with an opening formed radially inward are disposed intermittently along a circumferential direction; and an energizing mechanism for energizing the item held in one of the plurality of item holders radially inward and pushing out the item through the opening of the item holder substantially horizontally to the item ejection port when the opening is aligned with the item ejection port with rotation of the rotor, and wherein the energizing mechanism includes:

a push-into member provided in the proximity of each of the item holders of the rotor and energized inward from an outer circumferential side of the rotor; and a cam member adapted to release the push-into member only at a position where the opening of one of the plurality of item holders is aligned with the item ejection port with rotation of the rotor, and move the push-into member to the outer circumferential side of the rotor at any other positions.

2. The item dispensing device according to claim 1, wherein the push-into member includes:

a pantograph mechanism with a proximal end thereof provided on the outer circumferential side of the rotor, wherein the pantograph mechanism is adapted to extend and retract in a radial direction of the rotor; and an elastic member for driving the pantograph mechanism.

3. The item dispensing device according to claim 2, wherein the pantograph mechanism includes:

a bracket provided in the proximity of the outer circumference on a back surface of the rotor and provided with a pair of slits formed in an orthogonal direction to the radial direction of the rotor;

a pair of supporting shafts slidably attached to the pair of slits, respectively, the pair of supporting shafts energized by the elastic member in a direction approaching each other;

a pair of actuating arms with proximal ends thereof swingably attached to the pair of supporting shafts, respectively, wherein the pair of actuating arms is swingably connected with each other at centers of the both;

a pair of operating arms with proximal ends thereof swingably attached to tips of the pair of actuating arms, respectively; and a cam follower shaft for swingably connecting the tips of the pair of actuating arms with each other and for pushing out the item.

* * * * *